US007472801B1

(12) United States Patent
Moynihan et al.

(10) Patent No.: US 7,472,801 B1
(45) Date of Patent: Jan. 6, 2009

(54) WASTE BASKET LID SIMULATING SPORTS PLAYING FIELD

(76) Inventors: Kevin P. Moynihan, 425 Keystone Dr., Fenton, MO (US) 63026; Paul L. Schermesser, 119 Stonebriar Dr., Troy, IL (US) 62294

( * ) Notice: Subject to any disclaimer, the term of this patent is extended or adjusted under 35 U.S.C. 154(b) by 621 days.

(21) Appl. No.: 11/261,022

(22) Filed: Oct. 28, 2005

(51) Int. Cl.
*B65D 25/00* (2006.01)
*B65D 90/00* (2006.01)

(52) U.S. Cl. ..... 220/694; 273/317.3

(58) Field of Classification Search ..... 220/694, 220/729; 273/401, 402, 407, 317.3, 317.5; 473/479, 480; D34/1, 4
See application file for complete search history.

(56) References Cited

U.S. PATENT DOCUMENTS

| | | | | |
|---|---|---|---|---|
| 406,342 | A | 7/1889 | Dumont | 273/402 |
| 3,244,420 | A | 4/1966 | Poynter | 273/402 |
| 3,628,793 | A | 12/1971 | Mudloff | 273/402 |
| 3,810,616 | A | 5/1974 | Murphy | 473/456 |
| D307,962 | S | 5/1990 | Phelps et al. | D32/37 |
| D308,431 | S | 6/1990 | Phelps et al. | D32/37 |
| 4,976,355 | A | 12/1990 | Crutchfield | 206/457 |
| D339,890 | S | 9/1993 | Montgomery | D34/1 |
| 5,423,537 | A | 6/1995 | Santana | 273/85 R |
| 5,762,569 | A | 6/1998 | Hale | 473/480 |
| 5,909,877 | A | 6/1999 | Bour | 273/402 |
| 6,192,635 | B1 | 2/2001 | Zheng | 52/126 |

*Primary Examiner*—Anthony D Stashick
*Assistant Examiner*—Harry A Grosso
(74) *Attorney, Agent, or Firm*—Grace J. Fishel

(57) ABSTRACT

A waste basket lid simulating a sports playing field. The lid mounts as a cover over the top of a waste basket. The lid is formed from a panel with a hole through which waste material may be thrown. The hole is located near a sports goal which extends out of the plane of the panel adjacent an edge of the panel. Markings are provided on the panel associated with the markings found on the sports field being simulated. The panel may be mounted on a clamp about which it can pivot on a rim of the waste basket and may include a backstop along an edge of the panel to catch waste material that may be overthrown the hole.

14 Claims, 5 Drawing Sheets

WASTE BASKET LID SIMULATING SPORTS PLAYING FIELD

BACKGROUND OF THE INVENTION

1. Field of the Invention

The present invention relates to a lid for a waste basket with a top surface that simulates a playing field including a sports goal and a hole forming a target for waste material.

2. Brief Description of the Prior Art

Waste baskets come in a variety of shapes, e.g., round, oblong, square and the like. Conventional waste baskets either have no cover or a cover which must be removed or otherwise opened in order to provide access to the basket's interior.

Many different devices are known for converting a waste basket into a game. For example, miniature basketball backboards, hoops and nets have been proposed for attaching to a waste basket. The game of basketball is simulated when a user targets the basketball hoop with waste paper. Other sports such a soccer, football, etc. cannot be simulated in this manner as they do not have goals which can be hung over the waste basket in the manner of a basketball hoop.

What is needed therefore is a device which easily converts a waste basket into a miniature sports playing field. The device should be visually appealing and allow a player to make a game out of waste paper disposal. Such a device would allow the user to participate in a game at home and would be suitable for use at work. Team logos and the like could be applied to the playing field for additional interest and/or as a conversation piece.

BRIEF SUMMARY OF THE INVENTION

In view of the above, it is an object of the present invention to provide a waste basket lid with a hole that serves as a target for waste material to be thrown and that simulates a playing field. It is another object to provide a waste basket lid that can be pivoted for disposal of materials that a user does not want to throw through the hole and that can be easily removed to empty the basket. It is also an object to provide a waste basket lid which is suitable for office or home and which can serve as a conversation piece. Other objects and features of the invention will be in part apparent and in part pointed out hereinafter.

In accordance with the invention, a waste basket lid has a top surface simulating a portion of a sports playing field. The lid has a panel with a generally planar bottom surface for use as a lid on top of a waste basket. The top surface is also generally planar and has a sports goal located adjacent an edge of the panel. A hole through which waste material may be thrown is positioned near the sports goal which extends out of the plane of the top surface. Indicia are provided on the top surface corresponding to markings found on the sports field being simulated.

The sports goal may be a net, upright, flag or the like. A backstop may be provided along an edge of the panel behind the sports goal for the purpose of catching waste material that is overthrown the hole. The waste basket lid may be mounted on a clamp that receives and frictionally engages the rim of the waste basket and about which the lid may be pivoted such that waste material may be directly deposited in the waste basket. It may also include a brace for holding the lid in tipped-up position When the waste basket lid includes sports team, school or company indicia, the lid may serve as a conversation starter or as a symbol of belonging to or supporting an organization. A sensor may be provided with a feedback device that incorporates optional sound effects.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which several of various possible embodiments of the invention are illustrated, corresponding reference characters refer to corresponding parts throughout the several views of the drawings in which.

DETAILED DESCRIPTION OF THE INVENTION

Figure 1:
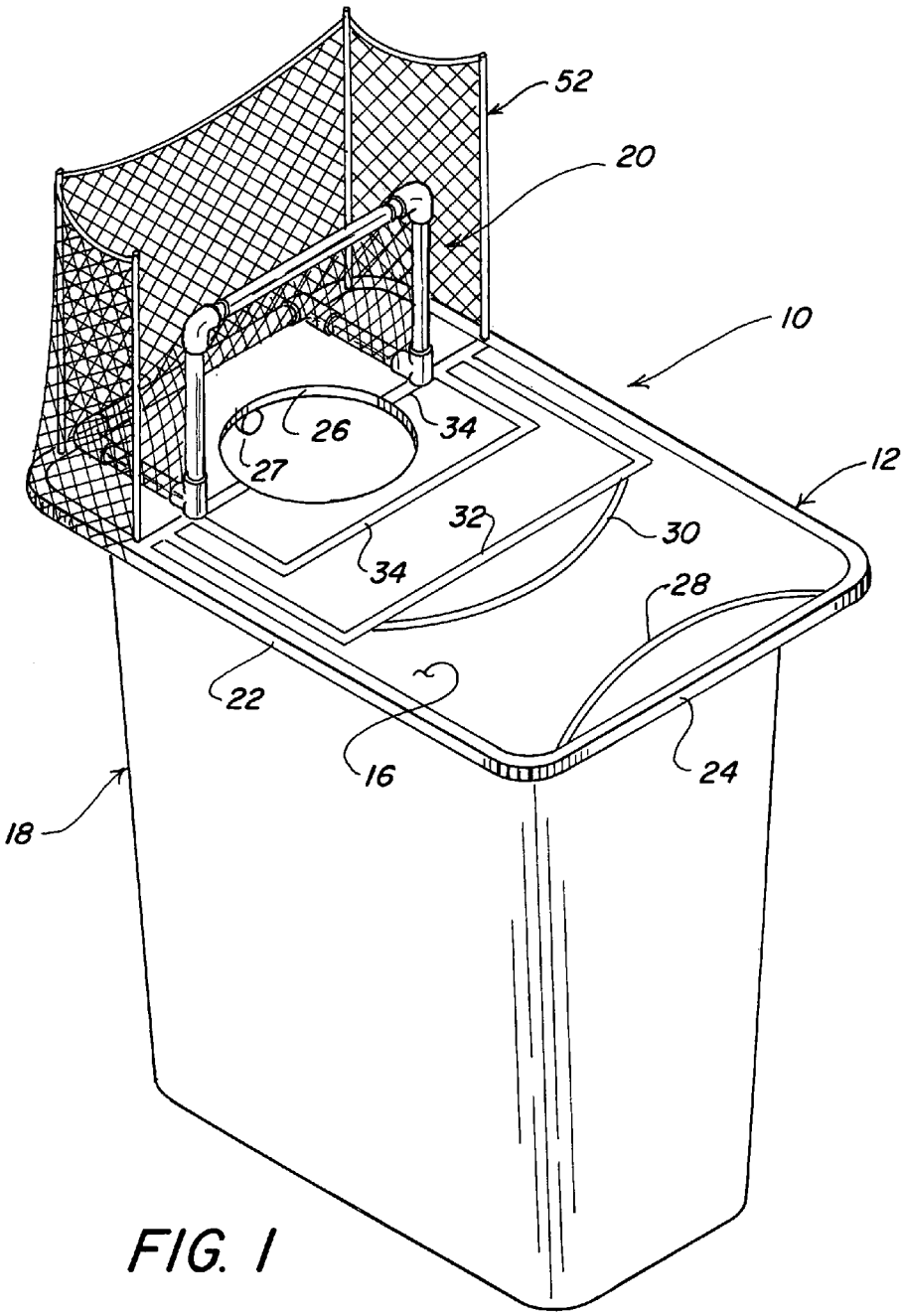
FIG. 1 is a perspective view of a waste basket lid simulating a soccer playing field in accordance with the present invention mounted on a waste basket.
Figure 2:
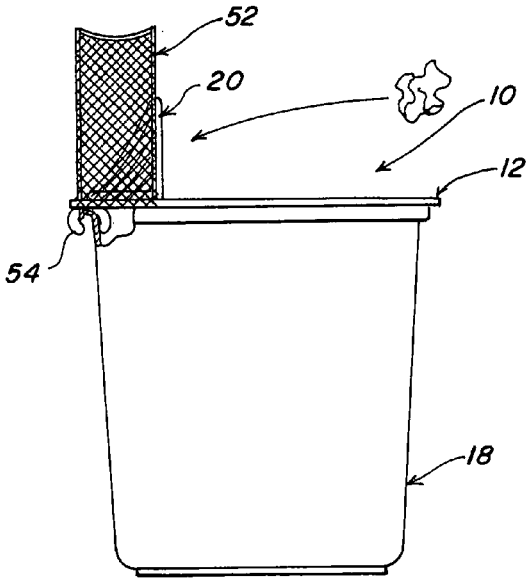
FIG. 2 is a side elevational view of the waste basket lid and waste basket shown in FIG. 1.
Figure 3:
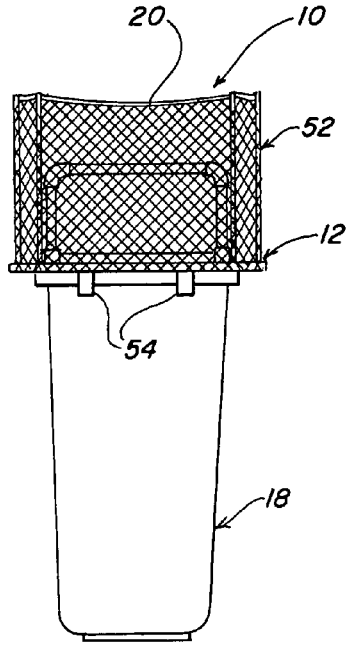
FIG. 3 is an end elevational view of the waste basket lid and waste basket.

Referring to the drawings more particularly by reference character, reference number 10 refers to a waste basket lid in accordance with the present invention. Waste basket lid 10 has a panel 12 with a generally planar bottom surface 14 and a generally planar top surface 16 on which a portion of a sports playing field is simulated.

Bottom surface 14 is adapted to be placed on top of an open-ended waste basket 18. Waste basket 18 can be any size, shape or material, which has an internal cavity for receipt of waste material such as wadded up waste paper. Panel 12 is complementary in shape and size to the open end of basket 18 such that when it is placed on top of the basket, panel 12 blocks the open end. As illustrated in the drawings, basket 18 is oblong or rectangular in shape. Such baskets are in common use in offices and homes and particularly lend themselves to use with waste basket lid 10 as many sports playing fields are elongated also.

A sports goal 20 extending out of the plane of top surface 16 is provided. When basket 18 is elongated, panel 12 has two long sides 22 and two short sides 24 and sports goal 20 is preferably located adjacent one of short sides 24. A hole 26 is provided through panel 12 near sports goal 20. Hole 26 is sized such that waste material such as wadded up waste paper drops through the hole; a feat which is more difficult to perform if the user is some distance from basket 18. As shown in FIG. 1, a sensor 27 may be provided on panel 12 to detect the passage of waste material through hole 26. Sensor 27 may include a feedback device that incorporates sound effects (such as a cheering crowd, college fight song, siren or the like) or a counter.

Waste basket lid 10 may be used to simulate a number of different games which are played upon a field, four illustrative ones of which are shown in the drawings. Other games such as lacrosse, rugby and the like may also be represented.

Indicia related to markings found on the sports field being simulated are provided. For example, waste basket lid 10 shown in FIG. 1 simulates a portion of a soccer playing field. Lines 28, 30, 32 and 34 represent a portion of a center circle, a penalty arc, penalty area line and goal line, respectively. Sports goal 20 is a net.

Figure 6:
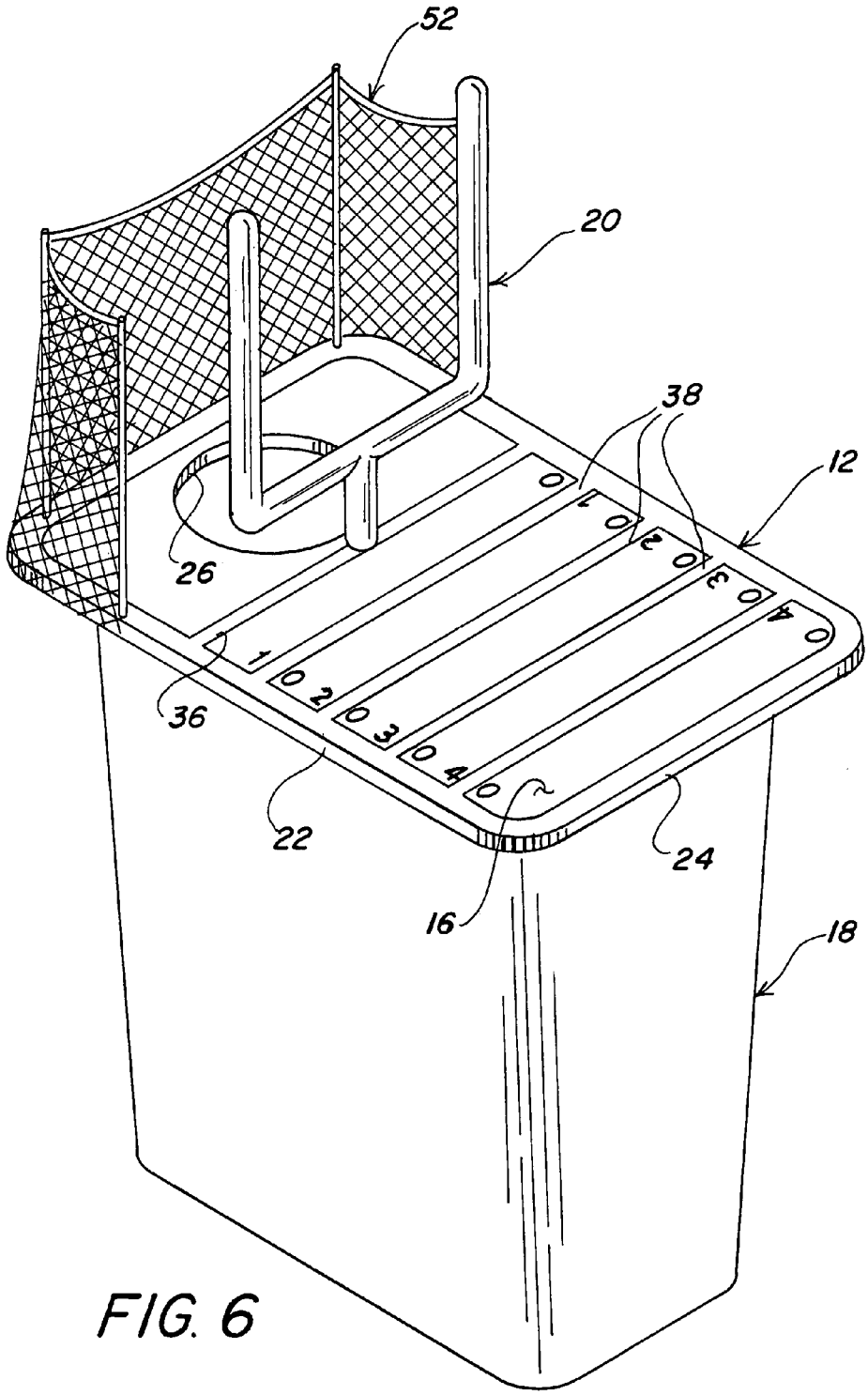
FIG. 6 is a perspective view of a waste basket lid simulating a football field mounted on a waste basket.
Figure 7:
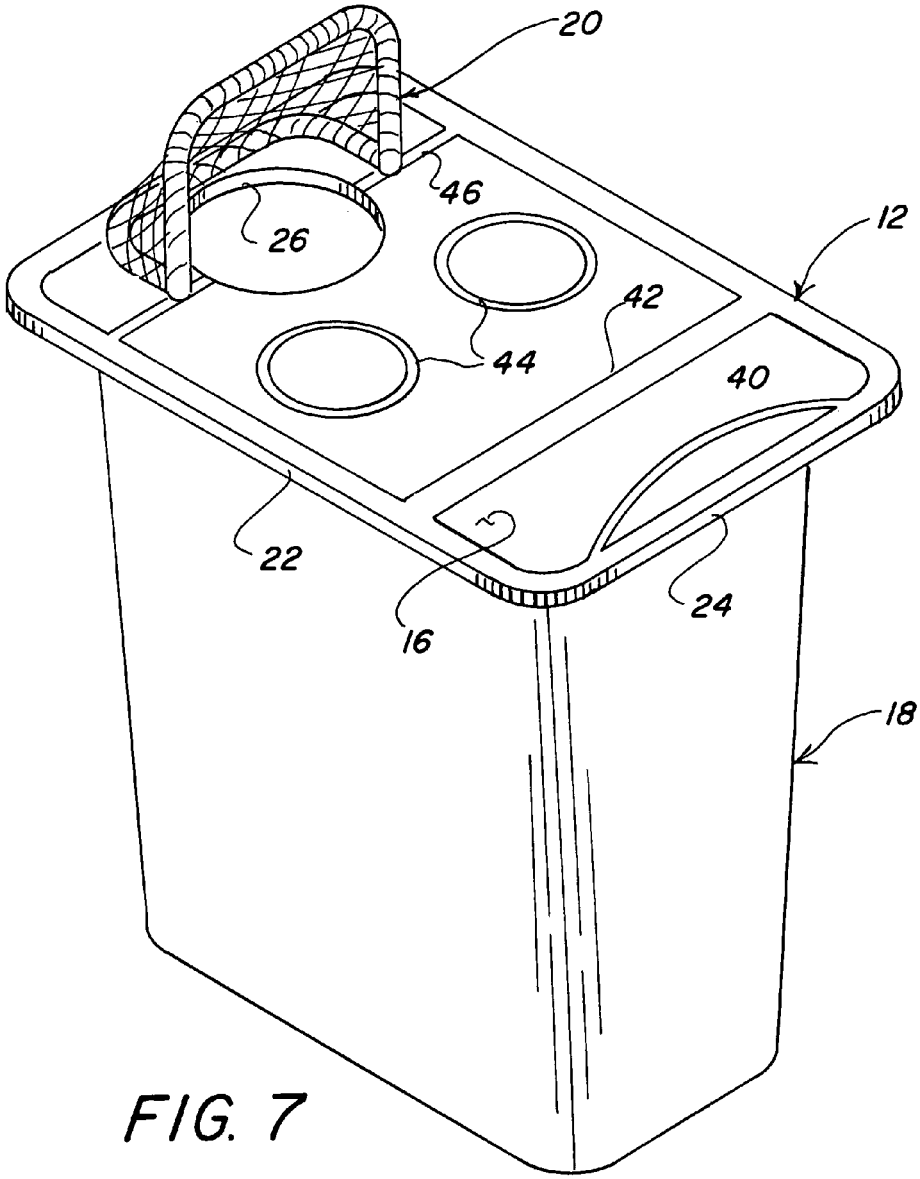
FIG. 7 is a perspective view of a waste basket lid simulating an ice hockey rink mounted on a waste basket.
Figure 8:
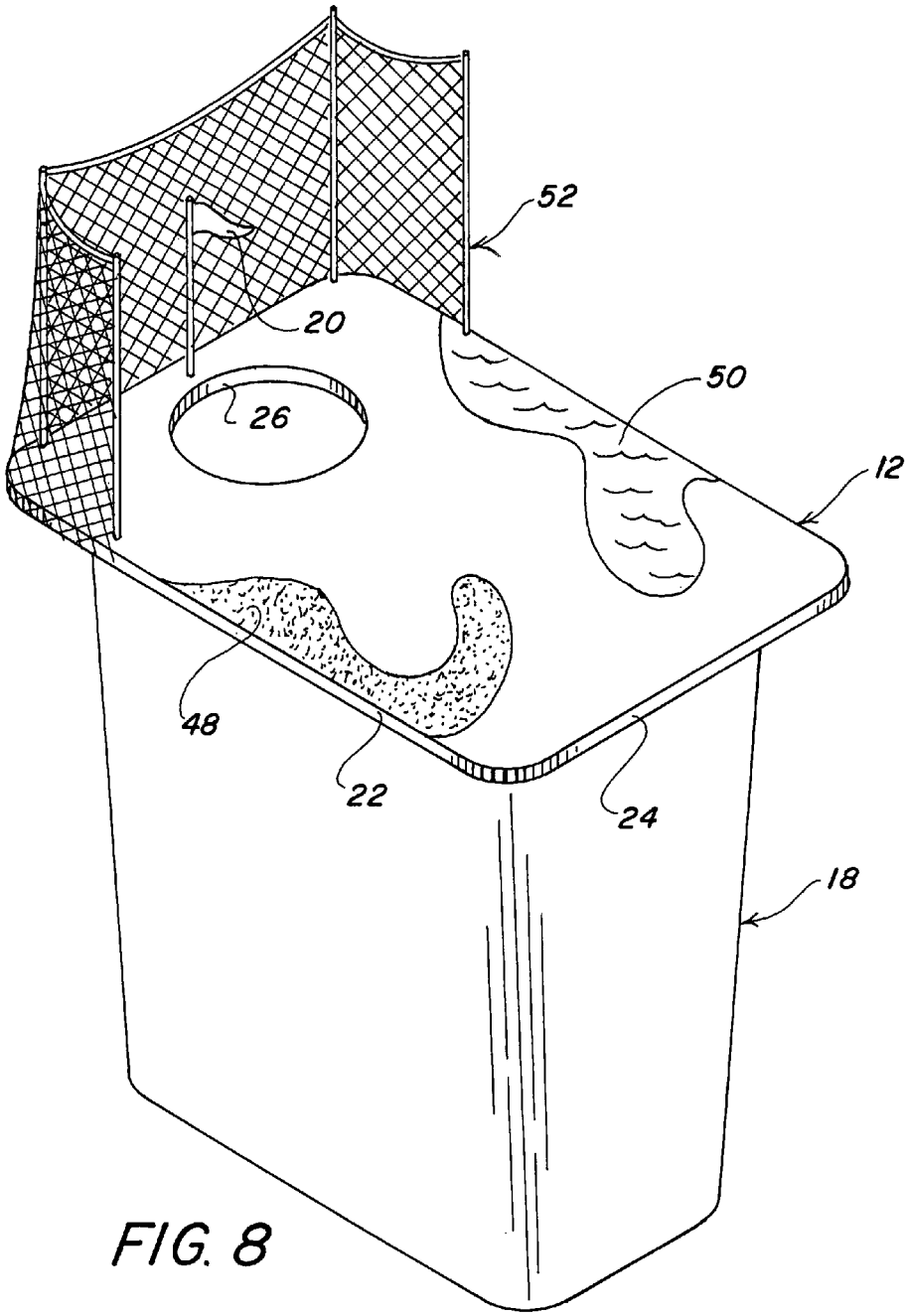
FIG. 8 is a perspective view of a waste basket lid simulating a golf green mounted on a waste basket.

A portion of a football field is simulated on waste basket lid 10 shown in FIG. 6. In this instance sports goal 20 is a football upright and the indicia on top surface 16 include a goal line 36 and several yard lines 38. In FIG. 7, a portion of an ice hockey rink is shown. Sports goal 20 is a net and indicia 40, 42, 44, and 46 represent a portion of center face-off circle, a red line, end face-off circles and a goal line, respectively. The sport illustrated in FIG. 8 is golf wherein sports goal 20 is a golf flag and indica 48 and 50 illustrate a sand trap and a water hazard, respectively. Sports goals 20 and indicia appropriate for other sports may be provided. Top surface 16 may also be provided with other indicia besides the markings found on the sports field being simulated. Such additional indicia include team logos, school mascots, company trademarks and so forth thus offering a licensing opportunity for sports teams and schools or a marketing tool for companies.

When sports goal 20 extends out of the plane of top surface 16 and is a net, it may not be necessary to provide a backstop 52 on the edge of panel 12 behind the goal for catching waste material that is overthrown hole 26. As illustrated in the drawings, backstop 52 is a net but it may be a panel or the like. When basket 18 is elongated and panel 12 has short sides 24 and long sides 22, backstop 52 is provided on the edge of panel 12 along short side 24 behind sports goal 20 and may extend along long sides 22 to partially encircle the sports goal. The purpose of backstop 52 is to catch waste material that is overthrown hole 26.

Figure 5:
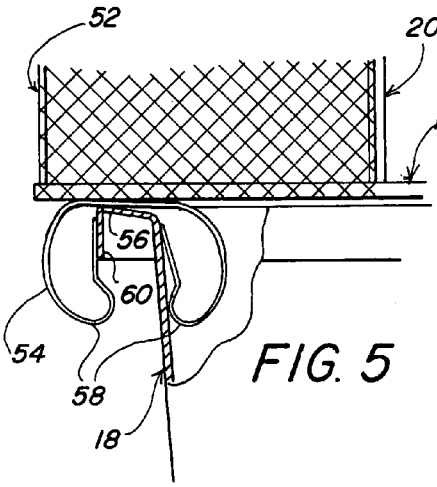
FIG. 5 is a detail on an enlarged scale taken along the line 5-5 in FIG. 4.
Figure 4:
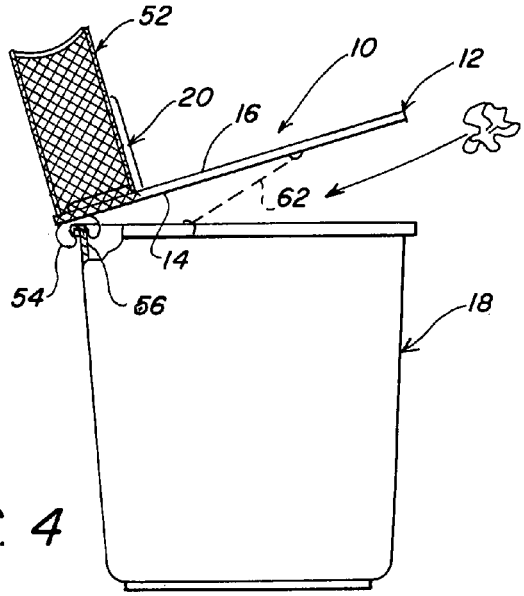
FIG. 4 is a side elevational view of the waste basket with the waste basket lid tipped and with a portion of the waste basket broken away to show a clamp upon which the lid is pivoted.

Waste basket lid 10 may be mounted on a clamp 54 attached to bottom surface 14. Clamp 54 receives and frictionally engages an upper peripheral rim 56 of waste basket 18 as best seen in FIGS. 4-5. In these drawings, clamp 54 is C-shaped in cross section and has bifurcated depending legs 58, the adjacent surface of which legs define the sides of a substantially U-shaped slot 60 for gripping peripheral rim 56 of basket 18. While a particular clamp has been shown in the drawings, it will be understood that other clamps may also be used; the requirements being that lid 10 may be mounted on them and that they receive and frictionally engage peripheral rim 56 of basket 18. It is also desirable, if clamp 54 allows a user to pivot lid 10 on peripheral rim 56 so that larger items may be thrown into basket 18 without removing lid 10 entirely. It may also be advantageous to lift lid 10 to dispose of smaller things such as paper punch holes, light materials such as tissues that do not throw well or for disposal of other things if the user tires of the game. Alternatively, a brace 62 (FIG. 4) may be provided for blocking lid 10 in tipped-up position.

In use, a user selects a waste basket lid 10 with top surface 16 simulating a portion of a sports playing field for a sport that he or she has a particular interest. When waste basket lid 10 includes additional indicia such as team logos, school names, company trademarks, etc., waste basket lid 10 may be a conversation starter with co-workers or visitors who may discover that they share a common interest. The additional indicia may also be used to signal belonging or a team spirit, attitudes that a company, for example, may want to foster in its employees.

Waste basket lid 10 is placed on top of waste basket 18. When clamp 54 is present, clamp 54 is pressed onto peripheral rim 56 of basket 18. Sports goal 20 and hole 26 are then used as a target for crumpled up paper or the like. Such playful activity may relieve the tedium of work, study or the like. For disposal of items which the user does not want to throw, lid 10 may be pivoted on peripheral rim 56 about clamp 54. Waste basket lid 10 may be easily removed for dumping the trash from basket 18 or if the user temporarily tires of the game.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting manner.

What is claimed:

1. A waste basket lid with a top surface simulating a portion of a sports playing field, said lid comprising a panel having a generally planar bottom surface adapted to be placed on top of a waste basket as a cover, said top surface being generally planar with a sports goal extending out of the plane of the top surface and located adjacent to an edge of the panel, a hole through which waste material may be thrown positioned near the sport goal, and indicia on the top surface, said indicia related to markings found on the sports field being simulated.

2. A waste basket lid according to claim 1 further comprising a backstop on the edge of the lid behind the goal for catching waste material that is overthrown the hole.

3. The waste basket lid according to claim 1 wherein the sports goal is a soccer goal and the indicia include a portion of a center circle, a penalty arc, a penalty area line and a goal line.

4. The waste basket lid according to claim 1 wherein the sports goal is a football goal and the indicia include a goal line and field lines.

5. The waste basket lid according to claim 1 wherein the sports goal is an ice hockey goal and the indicia include a goal line, end face-off circles, a red line and a portion of a center face-off circle.

6. The waste basket lid according to claim 1 wherein the sports goal is a golf flag and the indicia show water and sand traps.

7. A waste basket lid with a top surface simulating a portion of a sports playing field, said lid comprising a panel having a generally planar bottom surface adapted to be placed on top of a waste basket as a cover, a clamp attached to the bottom surface to receive and frictionally engage an upper peripheral rim of the waste basket, said top surface being generally planar with a sports goal extending out of the plane of the top surface and located adjacent an edge of the panel, a hole through which waste material may be thrown positioned near the sport goal, and indicia on the top surface, said indicia related to markings found on the sports field being simulated.

8. The waste basket lid according to claim 7 wherein the clamp is C-shaped in cross-section and has bifurcated depending legs, the adjacent surfaces of which legs define the sides of a substantially U-shaped slot for gripping the peripheral rim of the waste basket.

9. A waste basket lid with a top surface simulating a portion of a sports playing field, said lid comprising a panel having a generally planar bottom surface adapted to be placed on top of a waste basket as a cover, a clamp attached to the bottom surface to receive and frictionally engage an upper peripheral rim of the waste basket, said top surface being generally planar with a sports goal extending out of the plane of the top surface and located adjacent an edge of the panel, a hole through which waste material may be thrown positioned near the sport goal, a backstop positioned on the edge of the lid behind the goal for catching waste material that is overthrown the hole, and indicia on the top surface, said indicia related to markings found on the sports field being simulated.

10. The waste basket lid according to claim 9 wherein the sports goal is a soccer goal and the indicia include a portion of a center circle, a penalty arc, a penalty area line and a goal line.

11. The waste basket lid according to claim 9 wherein the sports goal is a football goal and the indicia include a goal line and field lines.

12. The waste basket lid according to claim 9 wherein the sports goal is an ice hockey goal and the indicia include a goal line, end face-off circles, a red line and a portion of a center face-off circle.

13. The waste basket lid according to claim 9 wherein the sports goal is a golf flag and the indicia show water and sand traps.

14. The waste basket lid according to claim 9 wherein the panel is rectangular with short and long sides, wherein the sports goal is located adjacent one of the short sides and wherein the backstop is a net that extends along the said one of the short sides and along the long sides to partially encircle the sports goal.

* * * * *